United States Patent [19]

Miles

[11] Patent Number: 4,488,947

[45] Date of Patent: Dec. 18, 1984

[54] PROCESS OF OPERATION OF CATHOLYTELESS MEMBRANE ELECTROLYTIC CELL

[75] Inventor: Ronald C. Miles, Cleveland, Tenn.

[73] Assignee: Olin Corporation, Cheshire, Conn.

[21] Appl. No.: 502,411

[22] Filed: Jun. 8, 1983

[51] Int. Cl.[3] ..... C25B 1/34

[52] U.S. Cl. ..... 204/98; 204/128

[58] Field of Search ..... 204/98, 128

[56] References Cited

U.S. PATENT DOCUMENTS

| | | | |
|---|---|---|---|
| 3,250,691 | 5/1966 | Brown, Jr. et al. | 204/98 |
| 3,773,634 | 11/1973 | Stacey et al. | 204/98 |
| 3,901,774 | 8/1975 | Motani et al. | 204/98 |
| 3,976,556 | 8/1976 | DeNora | 204/262 |
| 4,140,615 | 2/1979 | Kadija et al. | 204/98 |
| 4,265,719 | 5/1981 | Ezzel et al. | 204/98 |

FOREIGN PATENT DOCUMENTS

| | | | |
|---|---|---|---|
| 26297 | 3/1978 | Japan | 204/98 |

*Primary Examiner*—R. L. Andrews
*Assistant Examiner*—Terryence Chapman
*Attorney, Agent, or Firm*—James B. Haglind; Donald F. Clements

[57] ABSTRACT

An improved process for the electrolysis of an aqueous electrolyte in an electrolytic membrane cell is provided. The membrane cell is comprised of an anode compartment having at least one anode and containing the aqueous electrolyte and a cathode compartment containing at least one cathode and a concentrated catholyte liquor. A vertically positioned cation exchange membrane separates the anode compartment from the cathode compartment. The process improvement comprises exposing a substantial portion of the cathode to a gaseous atmosphere, this substantial portion of the cathode is not immersed in the concentrated catholyte liquor produced. The concentrated aqueous catholyte liquor is removed from the cathode compartment to prevent a substantial accumulation of catholyte liquor in the cathode compartment.

The improved process can be carried out in a novel electrolytic cell in which the cathode compartment is substantially reduced in size to permit a material savings as well as provide a higher production capacity per unit of floor space.

11 Claims, 6 Drawing Figures

PROCESS OF OPERATION OF CATHOLYTELESS MEMBRANE ELECTROLYTIC CELL

This invention relates to novel membrane type electrolytic cells for the electrolysis of aqueous electrolytes. More particularly, this invention relates to improved electrolytic cells and their operation in the electrolysis of aqueous salt solutions.

Commercial cells for the electrolysis of aqueous salt solutions, for example, alkali metal halide brines in the production of halogens and alkali metal hydroxides have been continually developed and improved over a period of time dating back to at least 1892. In general, chlor-alkali cells have been of the deposited asbestos diaphragm type or the flowing mercury cathode type. During the past few years, electrolytic cells employing ion exchange membranes (hereafter "membrane cells") have been developed which promise advantages over either diaphragm cells or mercury cells. It is desirable to provide cell designs which meet the requirements as well as exploit the advantages of these ion exchange membranes.

Suitable cation exchange membrane materials, such as those marketed by E. I. DuPont de Nemours and Company under the trademark "Nafion"; by Asahi Glass Company Limited under the trademark "Flemion"; and by Asahi Chemical Company under the trademark "Aciplex"; are available which permit the production of concentrated catholyte liquors. The catholyte liquors, for example, alkali metal hydroxides produced by the electrolysis of alkali metal chloride brines, have low concentrations of soluble impurities. These catholyte liquors, however, require further concentration before they can be sold commercially. It is therefore desirable to increase the concentration of catholyte liquors produced in the cell while maintaining high current efficiencies and low electrical energy requirements.

Now it has been discovered that concentrated catholyte liquors can be produced in an improved membrane electrolytic cell while significantly reducing capital costs.

It is an object of the present invention to provide an electrolytic process for producing catholyte liquors of increased concentration.

A further object of the present invention is to provide a membrane electrolytic cell having a simplified design and reduced capital costs.

Another object of the present invention is to provide an improved electrolytic process for the production of alkali metal hydroxide.

A still further object of the present invention is to provide a membrane electrolytic cell having increased production capacity per unit of floor space.

An additional object of the present invention is to provide electrolytic process which does not require dilution of the catholyte liquor produced in the cathode chamber.

These and other objects of the present invention are accomplished in a process for the electrolysis of an aqueous electrolyte in an electrolytic cell comprised of an anode compartment having at least one anode and containing the aqueous electrolyte; a cathode compartment containing at least one cathode and a concentrated catholyte liquor; a vertically positioned cation exchange membrane which separates the anode compartment from the cathode compartment, the process improvement which comprises exposing a substantial portion of the cathode to a gaseous atmosphere, said substantial portion of the cathode not being immersed in the concentrated catholyte liquor, while removing the concentrated aqueous catholyte liquor from the cathode compartment to prevent a substantial accumulation of catholyte liquor in the cathode compartment.

The invention will be better understood by reference to the attached drawings which are provided by way of illustration wherein:

DESCRIPTION OF THE PREFERRED EMBODIMENT

Figure 1:
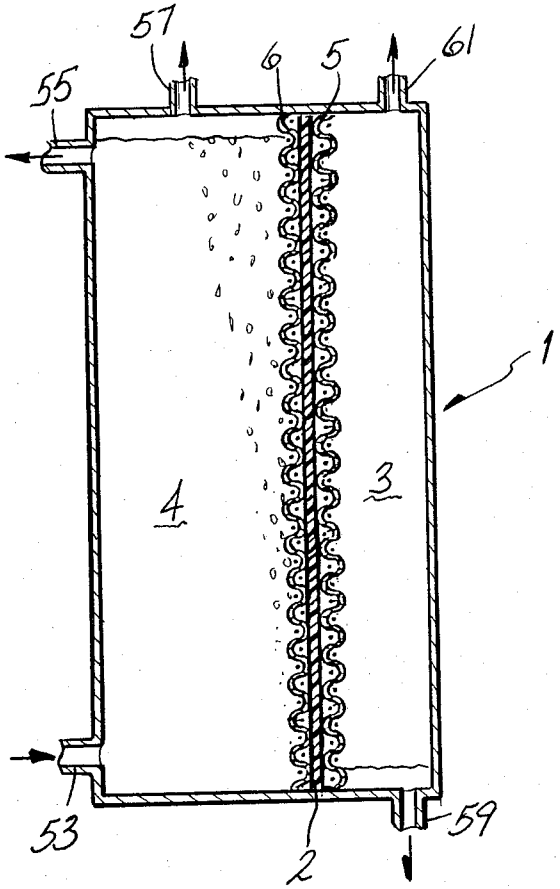
FIG. 1 is a schematic side view of one embodiment of a membrane electrolytic cell of the present invention.

Referring to FIG. 1, a schematic side view illustrates an electrolytic membrane cell indicated generally by the numeral 1 in which the membrane 2 is positioned vertically and separates the cell into cathode compartment 3 and anode compartment 4. Cathode 5 is positioned in cathode compartment 3 and in contact with one side of membrane 2. Anode 6 is positioned in anode compartment 4 and also contacts the other side of membrane 2. Cathode compartment 3 has outlet 59 in the lower portion for the removal of catholyte liquor and outlet 61 in the upper portion for removing gaseous products. Anode compartment 4 contains conduits 53 for introducing and 55 for removing electrolyte and outlet 57 for removing gaseous products produced during electrolysis.

Figure 2:
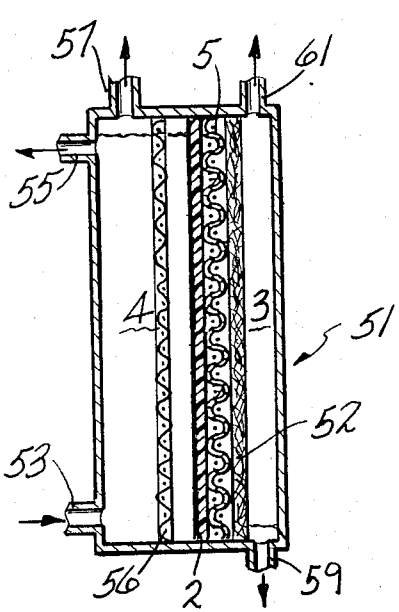
FIG. 2 illustrates a schematic side view of one embodiment of a membrane electrolytic cell in which the anode is spaced apart from the membrane.

FIG. 2 illustrates schematically the side view of an alternate embodiment of membrane electrolytic cell 51. Membrane 2 divides membrane electrolytic cell 51 into cathode compartment 3 and anode compartment 4. Cathode compartment 4 contains cathode 5 in contact with one side of membrane 2. In contact with the back side of cathode 5 is cloth 52. Anode compartment 4 contains anode 56 spaced apart from membrane 2.

Figure 3:
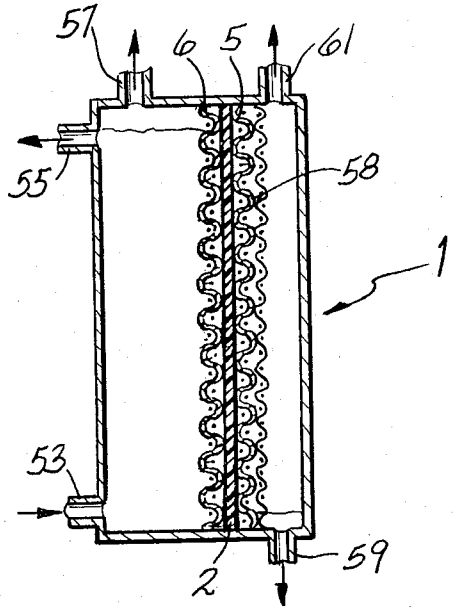
FIG. 3 depicts another embodiment of the vertical membrane electrolytic cell of the present invention.

An alternate embodiment of membrane electrolytic cell 1 is illustrated in FIG. 3 in which both cathode 5 and anode 6 are in contact with membrane 2 and fine mesh 58 is in contact with the back side of cathode 5.

Figure 4:
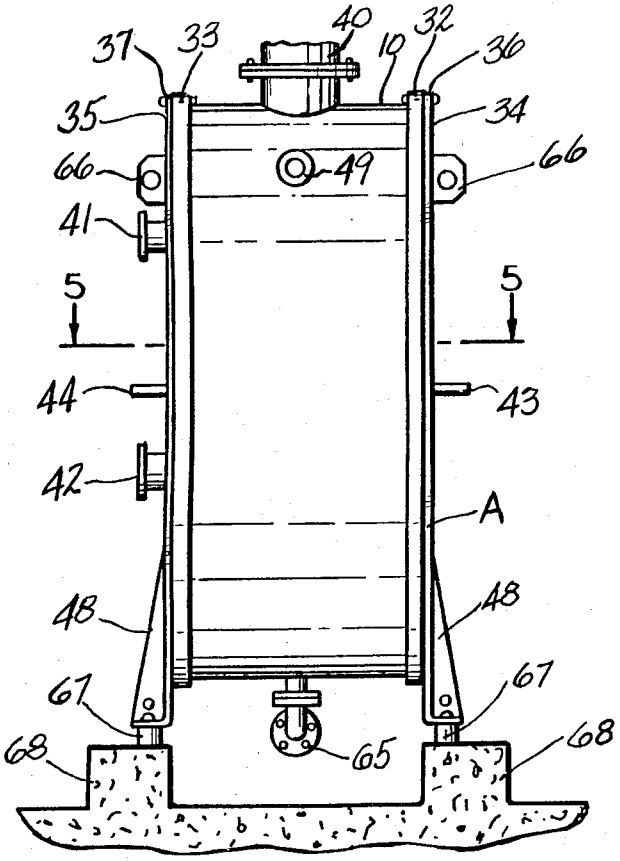
FIG. 4 illustrates a side view of an alternate embodiment of the membrane cell of the present invention.

FIG. 4 is a side view illustrating membrane cell A having a generally cylindrical cell body 10 and having flanges 32 and 33 surrounding each opening at the ends of the cell body 10. Cathode plate 34 is attached to flange 32 at one end of cell body 10 and anode plate 35 is attached to flange 33 at the other end of cell body 10. Gaskets 36 and 37 seal cathode plate 34 to flange 32 and anode plate 5 to flange 33, respectively.

An aqueous metal chloride solution to be electrolyzed enters through brine inlet 42 housed in anode plate 35. Chlorine gas and spent alkali metal chloride solutions are removed through outlet 41, and hydrogen gas is removed through outlet 40. Electric current is introduced to the cell through conductor 44 attached to anode plate 35. Current is removed from the cell at conductor 43 attached to cathode plate 34.

The cell is supported by plate supports 48 which are bolted or otherwise attached to insulators 67 resting on platforms 68.

Inlet 49 permits a liquid to be introduced into the cell. Outlet 65 removes the alkali metal hydroxide solution from the cell. Lugs 66 aid in the removal of cathode plate 34 and anode plate 35, respectively.

Figure 5:
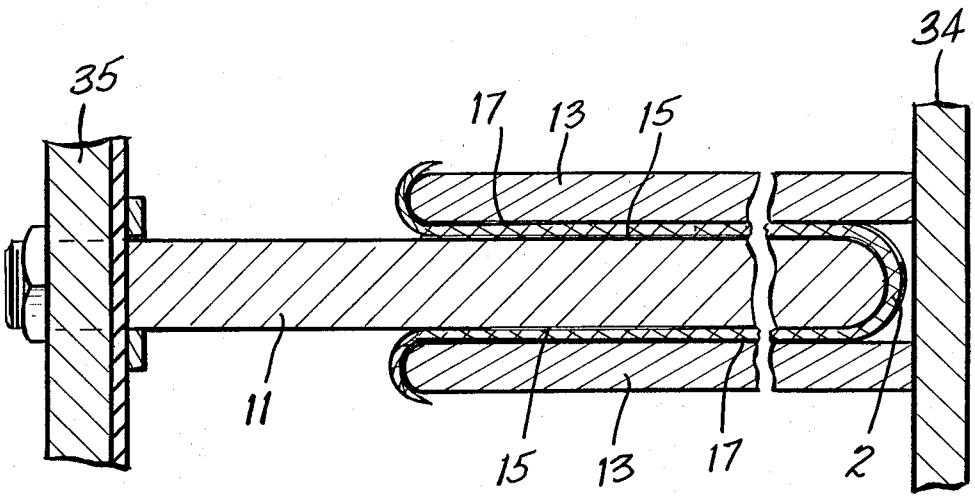
FIG. 5 represents a partial cross section of the anode and the cathode section of the membrane cell of FIG. 4 having interleaved electrodes.

FIG. 5 depicts a partial cross section of the electrode section of the membrane cell of FIG. 4 having anode 11 positioned between a pair of cathodes 13 and separated from cathodes 13 by membrane 2. Inner side 15 of membrane 2 is in direct contact with anode 11 and outer side 17 of membrane 2 is in direct contact with cathodes 13.

Figure 6:
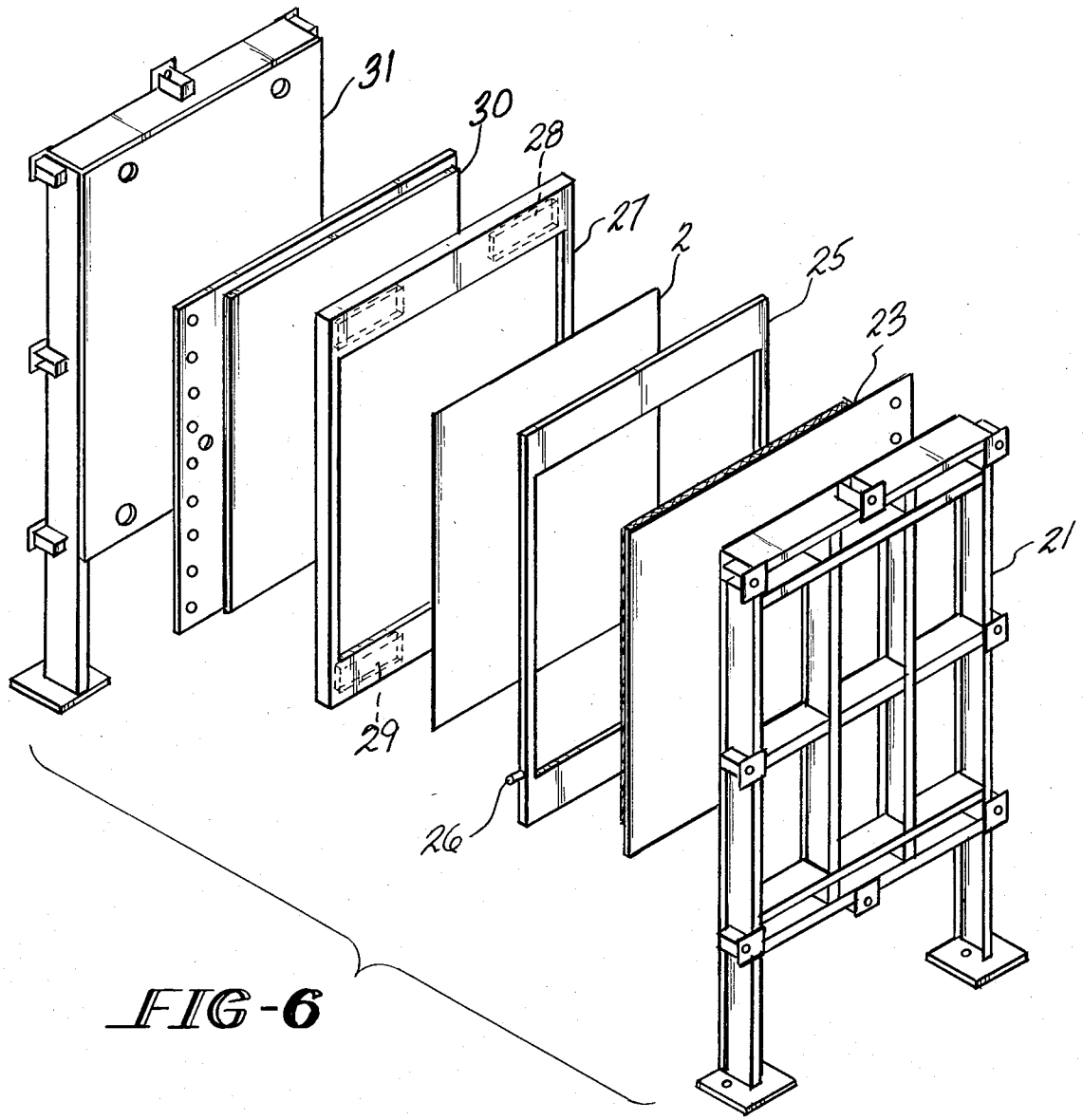
FIG. 6 depicts an exploded perspective view of an embodiment of a filter press membrane electrolytic cell of the present invention.

The electrolytic membrane cell of FIG. 6 is comprised of cathode end plate 21, cathode 23, cathode frame 25 having outlet 26, membrane 2, anode frame 27 having inlets 28 and outlets 29, anode 30 and anode plate 31.

In the novel electrolytic cell of the present invention, the cathode compartment is substantially reduced in width or thickness over that of the anode compartment, as illustrated in FIGS. 1–6. This reduction in width, permits a material savings for cathodes and related components as well as permitting the design of an electrolytic cell which provides a higher production capacity per unit of floor space. As the active electrode areas for membrane electrolytic cells are equilateral, where the active electrode area is defined as that portion of the electrode at which electrolysis takes place, a reduction in the volume of the cathode compartment, can be accomplished as the catholyte liquor is removed continuously from the lower part of the cathode compartment at substantially the rate at which it is produced. The production of catholyte liquor and gaseous product in the cathode compartment is the result of the decomposition of liquid, usually water, which is transported through the membrane, as a liquid such as water or an aqueous catholyte solution is not added to the cathode compartment. The immediate and continuous removal of the catholyte liquor as it is produced enables the cell to be operated substantially catholyteless and without the cathode or the membrane on the cathode side being immersed in a substantial body of catholyte liquor. Where this catholyte liquor is a concentrated alkali metal hydroxide solution, the removal of this solution substantially reduces corrosive attack of the alkali metal hydroxide upon the cathodes, the membrane, and particularly upon gasket materials. This continual draining of the catholyte liquor also permits the cell to be operated to produce maximum concentrations of alkali metal hydroxide for the cation exchange membrane employed, as there is no dilution of the catholyte liquor in the cathode compartment. The amount of catholyte liquor in the cathode compartment during operation of the cell is less than about 30 percent, preferably in the range of from about 0 to about 20 percent and more preferably at about 0 to about 10 percent of the volume of the cathode compartment.

The cathode is therefore exposed to a gaseous atmosphere over at least 70 percent, preferably 80 to 100 percent, and more preferably 90 to 100 percent of its active electrode area where this active electrode area is not immersed in the concentrated catholyte liquor. In the membrane electrolytic cell illustrated in FIG. 6, the concentrated catholyte liquor is preferably maintained at a level below the active electrode area. As illustrated, the anode frames are substantially greater in thickness than are the cathode frames, the thickness being at least 50 percent, and preferably at least 70 percent greater than the thickness of the cathode frames.

In the novel electrolytic cell of the present invention, the membrane can be positioned vertically or horizontally. However, it will be recognized that continuous immersion of the membrane, cathode and other components in a body of concentrated catholyte liquor occurs primarily in membrane cells where the membrane is positioned vertically.

The gaseous atmosphere present in the cathode compartment is normally provided by the gas which is produced in the cathode compartment. In the electrolysis of aqueous electrolytes such as alkali metal chloride brines, alkali metal bromide brines, alkali metal hydroxide solutions, or alkali metal sulfate solutions, where the alkali metals are, for example, sodium or potassium, the gas produced is hydrogen. However, if desired, inert gases such as nitrogen or argon may be introduced into the cathode compartment and admixed with the hydrogen produced to provide the gaseous atmosphere required.

Where hydrogen gas, for example, is generated in the cathode compartment, it is immediately released from the cathode and is not entrapped in a body of catholyte liquor. This immediate separation of hydrogen from the catholyte liquor permits a cell design in which disengagement means, either internal or external, for separating the hydrogen gas generated from the catholyte liquor can be eliminated. In addition, the novel cell of the present invention does not require catholyte liquor circulation means such as upcomers or downcomers.

During the operation of the cell, the addition of water or a caustic solution to the cathode compartment is not required as the only source of liquid to the cathode compartment is that which is transferred through the membrane. To prevent damage such as blistering to the membrane during start-up, it may be necessary to condition the membranes. This can be accomplished by one of several methods. For example, during the initial start-up period, the cell may be operated at low current densities, for example, those below about 1 kiloampere per square meter. During the start-up period, normally from about 2 to about 7 days, the current density is gradually increased until the cell is operating at the desired current density. In another embodiment, the cathode chamber can be filled with a dilute alkali metal hydroxide solution whose concentration increases during operation of the cell until it reaches the desired alkali metal hydroxide concentration. When this concentration is reached, the catholyte is drained from the cathode compartment and then continuously withdrawn at the rate at which it is produced.

As the only source of liquid to the cathode compartment is by transfer through the cation exchange membrane, the concentration of the catholyte liquor produced is directly related to the rate at which water is transported through the membrane.

In membrane cells, this rate, which is also known as the water transport number, may be defined by the following equation:

$$\text{Water Transport Number (moles/Faraday)} = \text{C.E. (\%)} \times 0.0222 \times [(100 \div \text{Cath. Concn. (\%)}) - 1] + 1$$

where Cath. Concn. is the catholyte concentration expressed as a percentage, and CE is the cathode current efficiency expressed as a percentage.

Suitable membranes employed in the novel electrolytic cell of the present invention have water transport numbers (WTN) in the range of from about 2 to about 5, preferably from about 2.5 to about 4, and more preferably at from about 3 to about 4 moles per Faraday.

Suitable cathodes employed in the electrolytic cell of the present invention include as electrode structures a metal screen, mesh, perforated plate or expanded metal. The cathodes have at least one catalytically active surface including, for example, porous surfaces such as those of a Raney metal (e.g. nickel or cobalt) or permeable catalytic electrodes such as those having cathode catalyst materials attached to or imbedded in the membrane or incorporated in a polymer matrix. Cathodes which can be employed in the novel cell of the present invention include those, for example, described in U.S. Pat. No. 4,116,804, issued Sept. 26, 1978, to C. Needes; U.S. Pat. No. 4,184,941, issued Jan. 28, 1980, to W. W. Carlin; U.S. Pat. No. 4,248,680, issued Feb. 3, 1981, to W. W. Carlin et al; U.S. Pat. No. 4,135,995, issued June 23, 1979, to C. N. Welch; U.S. Pat. No. 4,224,121, issued Sept. 23, 1980, to R. W. Dempsey et al; and U.S. Pat. No. 4,033,837, issued July 5, 1977, to H. C. Kuo et al.

One preferred cathode embodiment comprises a Raney metal alloy surface layer integral with and derived from a selected nickel alloy monolithic substrate structure. The surface layer is predominantly derived from an adherent crystalline precursor outer portion thereon comprising $Ni_xM_{1-x}Al_3$ Beta phase structure were M is a catalytic activator and where x, the fraction of nickel in the combined weight of Ni and M, is up to about 0.95.

As the catalytic activator, M is preferably molybdenum. However, it should be understood that the use of molybdenum is merely illustrative and that it may be replaced in whole or in part by ruthenium, titanium, tantalum, or mixtures thereof. X is preferably within the range of 0.80 to about 0.95. The cathodes are disclosed by T. J. Gray in U.S. Pat. No. 4,240,895, issued Dec. 23, 1980, which is incorporated herein in its entirety by reference.

Other suitable cathodes include highly porous reticulate cathodes comprised of electroconductive filaments and having a means of applying an electrical potential to the filaments. The term "filaments" includes fiber, threads or fibrils. The filaments may be those of the electroconductive metals themselves, for example, nickel, titanium, platinum, or steel, or of materials which can be coated with an electroconductive metal. Any materials which can be coated with these electroconductive metals may be used including, for example, metals such as silver, titanium, or copper, plastics such as polyarylene sulfides, polyolefins produced from olefins having 2 to about 6 carbon atoms and their chloro- and fluoro- derivatives, nylon, melamine resins, acrylonitrile-butadiene-styrene (ABS) copolymers, and mixtures thereof.

Where the filaments can be coated and are nonconductive to electricity, it may be necessary to sensitize the filaments by applying a metal such as silver, nickel, aluminum, palladium or their alloys by known procedures. The electroconductive metals are then deposited on the sensitized filaments.

Suitable reticulate electrodes and methods for their fabrication are described in U.S. Pat. No. 4,370,214, issued Jan. 25, 1983, to I. V. Kadija which is incorporated herein in its entirety by reference.

Any commercially available anodes for use in, for example, chlor-alkali or water electrolysis electrolytic cells may be employed in the electrolytic cell and process of the present invention. These include anodes of graphite or a foraminous valve metal such as titanium or tantalum having an electrochemically active coating over at least a portion of the anode surface. Suitable coatings include those of a platinum group metal, platinum group metal oxide, an alloy of a platinum group metal or mixtures thereof. The term "platinum group metal" means an element of the group consisting of ruthenium, rhodium, platinum, palladium, osmium and irridium. Coatings containing mixtures of valve metal oxides such as titanium oxides and platinum group metal oxides such as ruthenium oxide are described in U.S. Pat. No. 3,632,498 issued to H. B. Beer on Jan. 4, 1972. Other anodes which may be employed include those described in U.S. Pat. No. 4,333,805, issued June 8, 1982, to C. R. Davidson et al; U.S. Pat. No. 4,240,887, issued Dec. 23, 1980, to D. E. Hall; U.S. Pat. No. 4,200,515, issued Apr. 29, 1980, to D. E. Hall et al; U.S. Pat. No. 4,042,484, issued Aug. 16, 1977, to G. Thiele et al; U.S. Pat. No. 3,962,068, issued June 8, 1976, to D. Zoellner et al; and U.S. Pat. No. 3,992,280, issued Nov. 16, 1976, to C. Zoellner et al.

Cation exchange membranes, which can be employed as the electrolytic cell of the present invention, are inert, flexible membranes, which are substantially impervious to the hydrodynamic flow of the electrolyte and the passage of gas products produced in the cell. Suitably used, for example, are cation exchange membranes such as those comprised of fluorocarbon polymers having a plurality of pendant sulfonic acid groups or carboxylic acid groups or mixtures of sulfonic acid groups and carboxylic acid groups. The terms "sulfonic acid group" and "carboxylic acid group" are meant to include salts of sulfonic acid or salts of carboxylic acid which are suitably converted to or from the acid groups by processes such as hydrolysis. Suitable cation exchange membranes are sold commercially by E. I. DuPont de Nemours and Company under the trademark "Nafion"; by the Asahi Glass Company under the trademark "Flemion"; and by the Asahi Chemical Co. under the trademark "Aciplex".

The novel process of the present invention electrolyzes aqueous salt solutions over a wide range of current densities. For example, in the electrolysis of alkali metal chloride brines such as sodium chloride, where the NaCl concentration is from about 150 to about 300 grams per liter, and preferably from about 170 to 220 grams per liter, current densities up to about 20 kiloamperes per square meter of membrane surface area may be employed. Preferred current densities are those in the range of from about 2 to about 15 kiloamperes per square meter, with the more preferred range being from about 3 to about 12 kiloamperes per square meter. During cell operation, the anode compartment and the cathode compartment are maintained at substantially the same temperatures, for example, temperatures in the range of from about 80° to about 90° C.

The novel membrane electrolytic cell of the present invention can be monopolar or bipolar and can be operated with the electrodes spaced apart or in contact with the membrane. In a preferred embodiment, the cathode is placed in contact with the membrane as illustrated, for example, in FIGS. 1–4. Where the cathode is in contact with one side of the membrane, it may be desirable to employ moisture retaining means for retaining moisture on the cathode side of the membrane, as illustrated, for example, in FIGS. 3 and 4. The moisture retaining means is placed in contact with the back side of the cathode, that is, the side of the cathode opposite that in contact with the membrane. Suitable moisture retaining means include porous structures of non-conducting materials such as thermoplastics or textiles or foraminous metal structures such as expanded metal, perforated plates, or mesh, where the metal structure has a higher electrical resistance than that of the cathode and is not suitable as a cathode. The porosity of the moisture retaining means is selected to be less than the porosity of the cathode structure.

By employing the novel electrolytic membrane cell of the present invention, it is possible to reduce the volume of the cathode compartment; eliminate liquid addition to the cathode compartment; eliminate gas disengaging means; and eliminate recirculation means such as downcomers and upcomers from the cathode compartment. These reductions and eliminations substantially reduce the material and capital costs of the electrolytic membrane cell while permitting an increase in productivity per unit area of floor space.

The novel electrolytic process of the present invention produces catholyte liquor which is at the maximum concentration permitted by the membranes employed. For example, where the catholyte liquor is an alkali metal hydroxide such as sodium hydroxide, the catholyte concentration is at least 35 percent, and preferably from about 40 to about 50 percent by weight of NaOH.

The novel electrolytic cell and process of the present invention are illustrated by the following examples without any intention of being limited thereby.

EXAMPLE 1

An electrolytic membrane cell employed a cation exchange membrane having carboxylic acid functional groups (Flemion® membrane 753 produced by Asahi Glass Company and having a water transport number range of 3.9–4.2) to separate the anode compartment from the cathode compartment. The anode compartment contained a titanium mesh coated with ruthenium oxide as the anode. The anode was positioned in direct contact with one side of the membrane. A porous Raney nickel coated cathode was positioned in direct contact with the other side of the membrane. Concentrated sodium chloride brine (300 g/l of NaCl) was fed to the anode compartment and initially water was fed to the cathode compartment. The cell was operated at a current density of 3.0 $KA/m^2$, and an anolyte concentration of 200 grams per liter of NaCl to produce a 35% NaOH solution and hydrogen gas. Feeding water to the cathode compartment was discontinued and the drain at the bottom of the cathode compartment was opened and the caustic solution removed. The cell was operated continuously for a period of 22 days to produce a caustic solution having 41% by weight of NaOH. During operation of the cell the only water present in the cathode compartment was that which was transported through the membrane. The caustic solution produced was continuously removed to prevent prolonged contact between the cathode, membrane and a body of concentrated caustic solution by maintaining the concentrated caustic solution level below the active electrode area of the cathode. This resulted in 100% of the active electrode area of the cathode being exposed to the hydrogen gas atmosphere produced. For the period of operation, an average cell voltage of 3.19 volts, an average current efficiency of 94.2%, and a power consumption of 2274 kilowatt hours per metric ton of $Cl_2$ were attained. Visual examination of the membrane and cathode after cell shutdown indicated no obvious visual changes in the membrane other than those which occur in normal operation.

EXAMPLE 2

The cell of Example 1 was operated by the process of Example 1 where the cell employed a Flemion® 755 membrane, produced by the Asahi Glass Company. Initially, the cathode compartment was filled with an aqueous solution of sodium hydroxide (25% NaOH). The anolyte solution in the anode compartment had a NaCl concentration of 221 grams per liter. During cell operation, the current density was maintained at about 3 $KA/m^2$ and the water transport number was determined to be in the range of 3.1 to 3.6. After 35 days of operation, the cell was drained of the catholyte liquor (avg. NaOH concn. 35.1%). Cell operation was continued for 11 days with the catholyte level in the cathode chamber being maintained below the active electrode area of the cathode. The entire active electrode area was exposed to the hydrogen atmosphere produced in the cell. During the period of cell operation, the caustic solution producted had an average NaOH concentration of 43.8% with an average anolyte concentration of 224 gpl at an average cell voltage of 3.24 volts and a current efficiency of 84.5%.

What is claimed is:

1. In a process for the electrolysis of an aqueous electrolyte in an electrolytic cell comprised of an anode compartment having at least one anode and containing said aqueous electrolyte; a cathode compartment containing at least one cathode and a concentrated catholyte liquor; a vertically positioned cation exchange membrane which separates said anode compartment from said cathode compartment, the process improvement which comprises exposing a substantial portion of said cathode to a gaseous atmosphere, said substantial portion of said cathode not being immersed in said concentrated catholyte liquor being at least 70 percent of the active electrode area, while removing said concentrated aqueous catholyte liquor from said cathode compartment to prevent a substantial accumulation of catholyte liquor in said cathode compartment.

2. The process of claim 1 in which said gaseous atmosphere is hydrogen gas or mixtures of hydrogen gas and an inert gas.

3. The process of claim 2 in which said aqueous electrolyte is an alkali metal chloride brine.

4. The process of claim 3 in which said concentrated aqueous catholyte liquor is an alkali metal hydroxide.

5. The process of claim 4 in which said alkali metal chloride brine is sodium chloride having a concentration of from about 150 to about 300 grams per liter of NaCl.

6. The process of claim 5 in which said alkali metal hydroxide is sodium hydroxide having a concentration of from about 40 to about 50% by weight of NaOH.

7. The process of claim 6 in which the current density is up to about 20 kiloamperes per square meter of membrane surface.

8. In a process for the electrolysis of an aqueous electrolyte in the anode compartment of an electrolytic cell to produce a concentrated aqueous catholyte liquor in the cathode compartment; the electrolytic cell having a vertically positioned cation exchange membrane which separates the anode compartment from the cathode compartment, the process improvement which comprises maintaining the level of said concentrated catholyte liquor below the active electrode area of said cathode.

9. A process for producing a concentrated aqueous alkali metal hydroxide solution by the electrolysis of an aqueous alkali metal chloride solution in an electrolytic cell having an anode compartment, a cathode compartment, and a vertically positioned cation exchange membrane separating the anode compartment and the cathode compartment, where the process comprises:

(a) electrolyzing said aqueous alkali metal chloride solution to produce chlorine in said anode compartment and a concentrated aqueous alkali metal hydroxide solution in said cathode compartment; and (b) removing said concentrated aqueous alkali metal hydroxide solution as it is produced to maintain the amount of said concentrated aqueous alkali metal hydroxide solution in said cathode compartment at less than about 30 percent of the volume of said cathode compartment.

10. The process of claim 9 in which said concentrated aqueous alkali metal hydroxide solution has a concentration of at least about 35% by weight of NaOH.

11. The process of claim 10 in which the current density is up to about 20 kiloamperes per square meter of membrane surface.

* * * * *